US006036575A

United States Patent [19]

Rehkemper et al.

[11] Patent Number: 6,036,575

[45] Date of Patent: Mar. 14, 2000

[54] HOPPING MECHANISM FOR MODEL CAR

[75] Inventors: Steven F. Rehkemper, Chigaco; Jeffrey G. Rehkemper, Chicago, both of Ill.

[73] Assignee: Craft House Corporation, Toledo, Ohio

[21] Appl. No.: 09/233,673

[22] Filed: Jan. 19, 1999

[51] Int. Cl.[7] ..... A63H 17/26; A63H 17/00

[52] U.S. Cl. ..... 446/466; 446/437

[58] Field of Search ..... 446/437, 431, 446/443, 448, 454, 461, 460, 463, 466

[56] References Cited

U.S. PATENT DOCUMENTS

| | | | |
|---|---|---|---|
| 4,125,261 | 11/1978 | Lahr | 446/460 X |
| 4,218,846 | 8/1980 | Lahr | 446/443 |
| 4,696,655 | 9/1987 | D'Andrade et al. | 446/466 |
| 5,527,059 | 6/1996 | Lee, Jr. | 446/466 |
| 5,643,041 | 7/1997 | Mukaida | 446/466 X |
| 5,722,872 | 3/1998 | Simmons et al. | 446/466 X |
| 5,762,533 | 6/1998 | Tilbor et al. | 446/466 |

*Primary Examiner*—D. Neal Muir

*Attorney, Agent, or Firm*—Donald R. Fraser

[57] ABSTRACT

A model car having a mechanism driven by a reversible electric motor for selectively raising and lowering the front or rear of the car.

3 Claims, 4 Drawing Sheets

HOPPING MECHANISM FOR MODEL CAR

BACKGROUND OF THE INVENTION

1. Field of the Invention

The invention relates to model cars and more particularly to a model car which can be assembled from a kit requiring minimum skill and tools. Further, the front or the rear of the body of the assembled model car may be selectively raised and lowered in respect of the ground engaging wheels.

2. Prior Art

The prior art is replete with model cars and other similar vehicle replicas having wheels which may be driven, typically by a D.C. electric motor, to propel the vehicle forward or backward. Such motion of a vehicle imparts great interest in the attending youth.

SUMMARY OF THE INVENTION

It is an objective of the invention to produce a model car which can be selectively caused to raise or lower the front or the rear end of the body relative to the respective ground engaging wheels.

Another objective of the present invention is to produce a model car wherein the front or the rear end of the body of the model car may be selectively raised or lowered in respect of the associated ground engaging wheels by a reversible direct current electric motor.

Still another object of the invention is to produce a model car kit comprised of a number of individual components which may be readily assembled with a minimal number of tools by a person having minimal dexterity.

The above as well as other objectives of the invention may be typically achieved by a model car assembly including:

- a chassis;
- a first set of ground engaging wheels;
- a second set of ground engaging wheels;
- a first set of axle arms having outer and inner ends, the axle arms rotatably receiving the first set of ground engaging wheels at the outer ends of the first set of axle arms;
- a first pivotal mounting means intermediate the outer and inner ends of the first set of axle arms for pivotally mounting the first set of axle arms to the chassis;
- a second set of axle arms having outer and inner ends, the axle arms rotatably receiving the second set of ground engaging wheels at the outer ends of the second set of axle arms;
- a second pivotal mounting means intermediate the outer and inner ends of the second set of axle arms for pivotally mounting the second set of axle arms to the chassis;
- a reversible drive motor;
- a first cam member engaging the first set of axle arms between inner end thereof and the first pivotal mounting means;
- a second cam member engaging the second set of axle arms between the inner end thereof and the second pivotal mounting means; and
- a gear train coupled to the drive motor to drive the first cam member when caused to operate in a first direction and to drive the second cam member when caused to operate in a direction opposite to the first direction.

BRIEF DESCRIPTION OF THE DRAWINGS

The above objects and advantages, as well as others, will become clearly apparent to one skilled in the art from reading the following detailed description of a preferred embodiment of the invention when considered in the light of the attached drawings, in which.

DETAILED DESCRIPTION OF THE PREFERRED EMBODIMENT OF THE INVENTION

Figure 1:
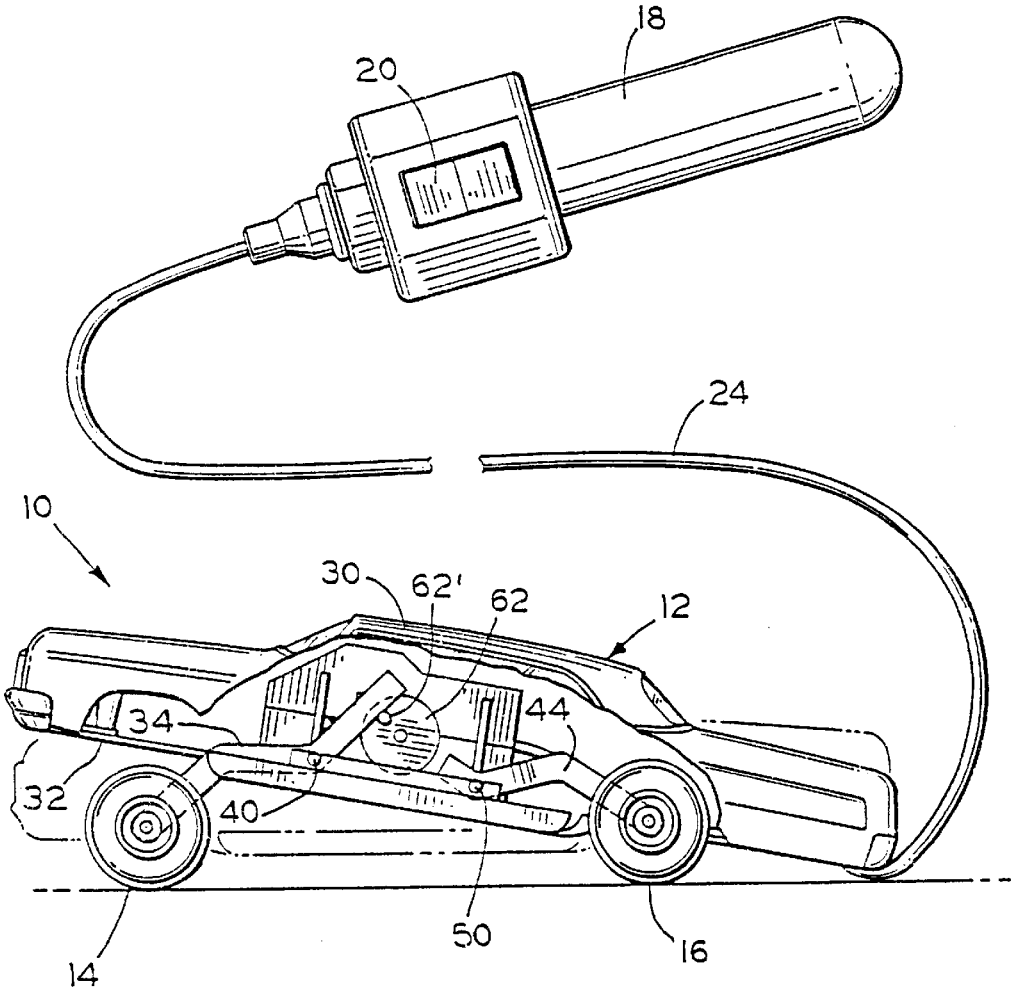
FIG. 1 is a side elevational view with portions cut away to more clearly illustrate the features of a model car incorporating the features of the invention.

Referring to the drawings, there is illustrated a preferred embodiment of the invention in the form of a model car capable of selectively raising or lowering the front or rear of the body of the car in respect of the associated front or rear wheel assemblies.

Figure 2:
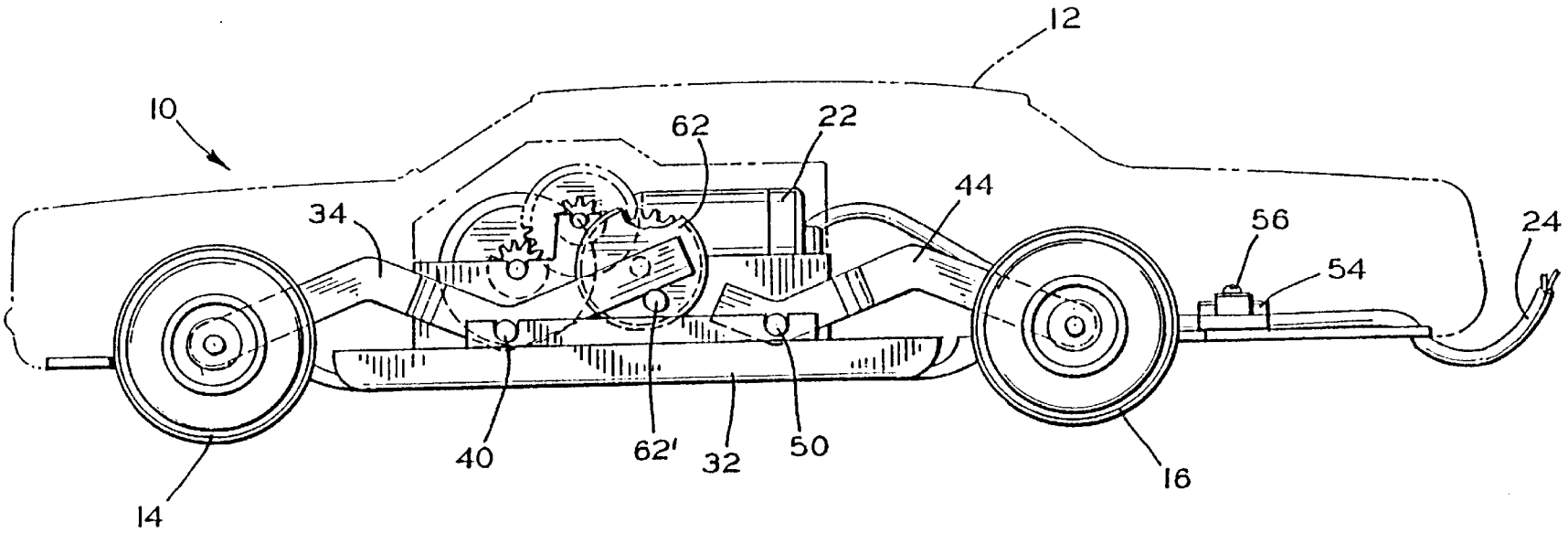
FIG. 2 is an enlarged side elevational view of the model car illustrated in FIG. 1 with the body portion illustrated in phantom.
Figure 3:
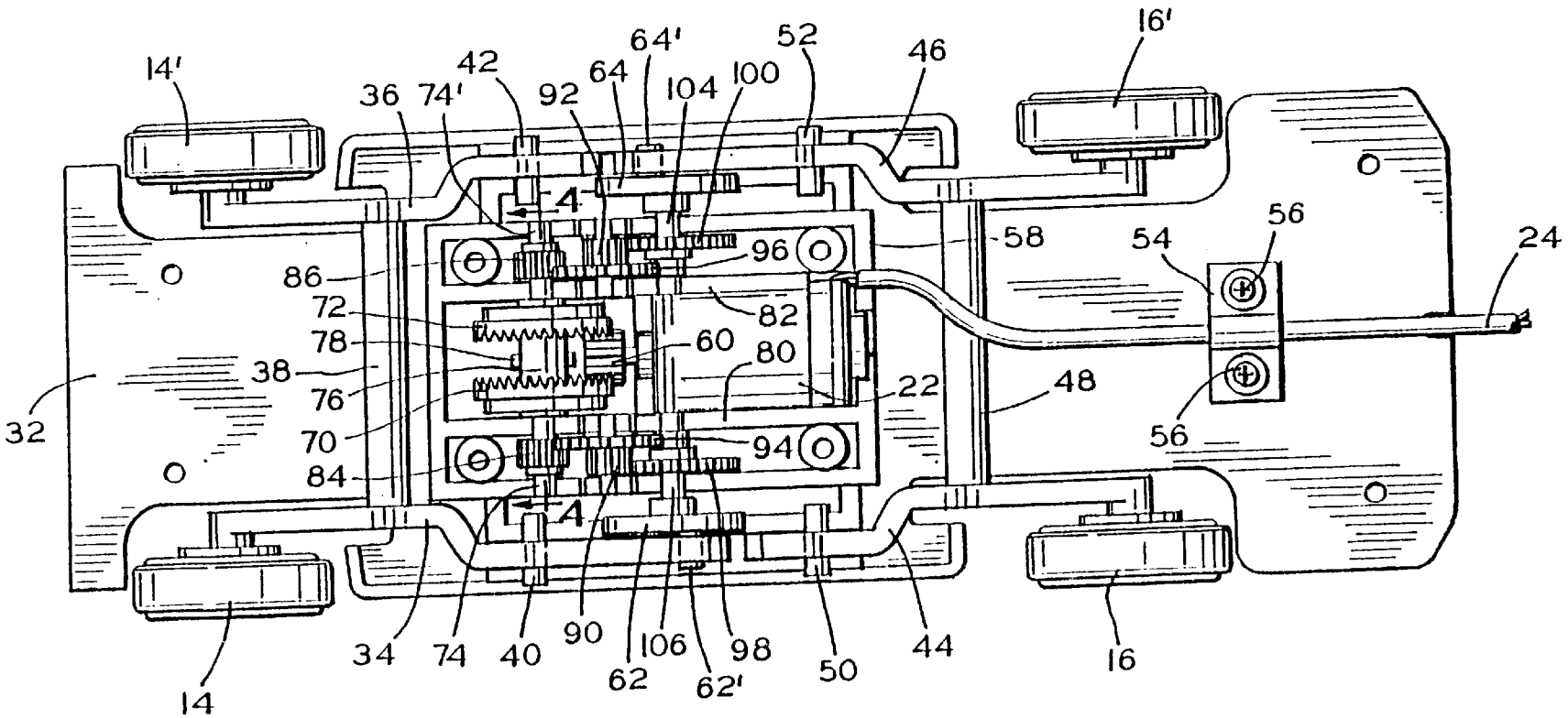
FIG. 3 is a top plan view of the model car illustrated in FIG. 2.
Figure 4:
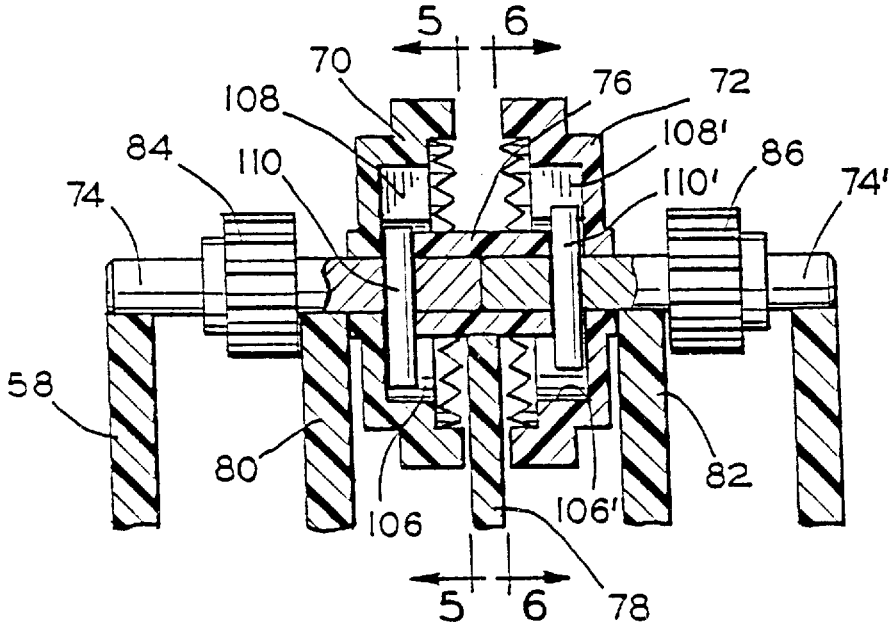
FIG. 4 is an enlarged sectional view of the gear train of the invention taken along line 4—4 of FIG. 3.

More specifically, there is shown in FIGS. 1, 2, and 3 a model car, generally indicated by reference numeral 10, including a body assembly 12; ground engaging front wheels 14, 14'; ground engaging rear wheels 16, 16'; and a power source 18, containing suitable batteries and having a rocker switch 20, coupled to a reversible electric motor 22 through a flexible electric cord 24.

The body assembly 12 includes a body 30 which typically replicates the sheet metal, glass, and bumpers of a conventional commercially sold vehicle, such as a 1964 Chevrolet Impala (trademarks owned by General Motors Corporation, U.S.A.). The body assembly 12 also includes a chassis 32 formed to replicate the vehicle frame, suspension system, and certain other components of the running gear. The body 30 and the chassis 32 may typically be formed of a plastic material which may be formed to genuinely represent the commercial vehicle. The plastic components may be glued together and/or assembled by suitable threaded fasteners.

The actual suspension of the model car 10 is achieved through the use of a front axle arm assembly and a rear axle arm assembly. The front axle arm assembly includes a pair of spaced apart generally parallel axle arms 34, 36 integrally joined together by a cross arm 38. Pivot pins 40, 42 are disposed intermediate the ends of the axle arms 34, 36, respectively. The forward outwardly extending terminal portions of the front axle arms 34, 36 are adapted to pivotally receive the ground engaging wheels 14, 14', respectively.

The rear axle arm assembly includes a pair of spaced apart generally parallel axle arms 44, 46 integrally joined together by a cross arm 48. Pivot pins 50, 52 are disposed intermediate the ends of the axle arms 44, 46, respectively. The rearward outwardly extending terminal portions of the rear axle arms 44, 46 are adapted to pivotally receive the ground engaging wheels 16, 16', respectively.

The reversible electric motor 22 is suitably mounted in an appropriately formed base of a two-piece enclosure 58 suitably secured to the chassis 32. The flexible power cord 24 is caused to extend rearwardly of the chassis 32 of the model car 10 and maintained centrally of the rear of the chassis 32 by a bracket 54 secured to the chassis 32 by threaded fasteners 56.

The motor 22 is provided with an output shaft having an output gear 60 secured thereto. The output gear 60 serves as the power input gear of a gear train which is capable of selectively delivering power to oppositely disposed cam wheels 62, 64. The cam wheel 62 is effective to drive the front axle arm assembly and the cam wheel 64 is effective to drive the rear axle arm assembly, as will be explained in detail hereafter.

The gear train is disposed within the base of the enclosure 58. The gear train includes a pair of spaced apart ring gears 70, 72 mounted to freely rotate on a split shaft 74, 74' the opposite outer ends of which are rotatably supported in grooves formed in the upstanding sides of the base of the enclosure 58. The inner ends of the split shaft 74, 74' are maintained in alignment by a hollow collar 76 mounted to rotate in a groove formed in an upright yoke 78 extending upwardly from the interior of the base of the enclosure 58. The hollow collar 76 functions to maintain the spaced relation between the ring gears 70, 72. Immediately adjacent the outer surfaces of the gears 70, 72, the split shafts 74, 74', respectively are mounted to rotate in grooves formed in interior upstanding walls 80, 82 of the base of the enclosure 58. Suitable gears 84, 86 are keyed or otherwise permanently affixed to the split shafts 74, 74', respectively.

A pair of stepped gears 90, 92 having supporting shafts 94, 96, respectively keyed or otherwise affixed thereto. The gears 90, 92 are effective to transmit motion to the cam wheels 62, 64, respectively, through respective gears 98, 100. The ends of the shafts 94, 96 are rotatably supported in grooves formed in the side walls of the base of the enclosure 58 and the spaced apart adjacent interior walls 80, 82, respectively.

Each of the cam wheels 62, 64 is provided with a supporting shaft 102, 104, respectively to which the wheels are keyed or otherwise suitably affixed. The shafts 102, 104 are supported in grooves formed in the upstanding interior walls 80 and 82 and the adjacent upstanding sides of the base of the enclosure 58.

The cam wheel 62 is provided with an outwardly projecting cam 62', while the cam wheel 64 is provided with an outwardly projecting cam 64'. The cams 62', 64' are effective causing movement of the front axle arm 34 and the rear axle arm 46, respectively.

Figure 5:
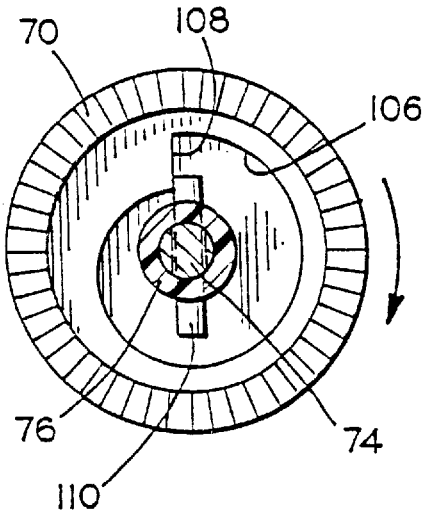
FIG. 5 is an enlarged sectional view taken along line 5—5 of FIG. 4 of a ring gear of the gear train for driving the cam member for effecting the raising or lowering of the front end of the body showing the drive gear.

Motion is transmitted through the gear train from the motor 22 in the following manner. Initially, let it be assumed that output gear 60 of the motor 22 is effective to cause clockwise rotation of the ring gear 70 as illustrated in FIG. 5. The inner face of the ring gear 70 is provided with a ledge-like surface or shelf 106 in the form of a spiral for 180° and a circle for 180° interconnected by a shoulder 108.

The split shaft 74 is provided with a bore hole extending therethrough normal to the rotational axis of the shaft. A pin 110 of slightly less outer diameter than the diameter of the hole in the shaft 74 is adapted to readily slide within the hole. Assuming that initially neither of the ends of the pin 110 were in contact with the shoulder 108, and the gear 70 is free to rotate relative to the shaft 74 upon continued clockwise rotation of the gear 70 the pin 110 will drop, causing an end thereof to contact the shoulder 108. Thereafter, the clockwise rotation of the gear 70 and the shaft 74 will rotate in unison, as shown in FIG. 5.

Figure 6:
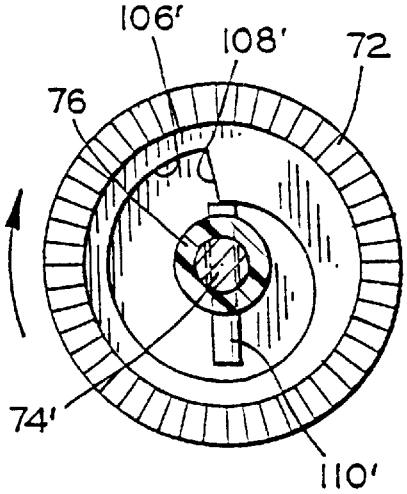
FIG. 6 is an enlarged elevational view taken along line 6—6 of FIG. 4 of a ring gear of the gear train for driving the cam member for operating the rear end of the body wherein the ring gear is rotatably free of the associated cam member.

Turning to FIG. 6, there is shown the interior view of the cooperating ring gear 72 having an interior configuration which is a mirror image of the interior of the ring gear 70. The gear 72 is provided with a ledge-like surface or shelf 106' which extends generally annularly in the form of a spiral for approximately 180° and a circle for the balance of the path completely around the interior surface of the gear 72. The path of the shelf 106' commences and terminates in a shoulder 108'.

The associated split shaft 74' is provided with a bore hole extending therethrough normal to the rotational axis of the shaft. A pin 110' of slightly less outer diameter than the diameter of the hole in the shaft 74' is adapted to readily slide within the hole.

It will be observed that the ring gear 72 is driven by the associated drive gear 60 of the motor 22 in the direction of the arrow in FIG. 6. By such motion, the pin 110' is urged or cammed out of contact with the shoulder 108'. Since there is then no positive contact between the face of the shoulder 108' and the pin 110', the gear 72 is in effect free wheeling and will not transmit power or rotary motion through the gear train to the cam wheel 64.

Accordingly, it will be appreciated that by driving the ring gears 70, 72 in the directions illustrated in FIGS. 5 and 6, only the cam wheel 62 and the cam member 62' are caused to move.

While mention has not earlier been made, it will be understood that once the motor 22 and all the associated gears of the gear train, as clearly illustrated in FIG. 3, are in operative position within the base of the enclosure 58, the upper portion of the enclosure 58 is placed over the base and threaded fasteners are typically employed to maintain upper portion in place and simultaneously hold the gear shafts and pivot pins in place.

As the cam wheel 62 is caused to rotate, the cam pin 62' urges the axle arm 34 to pivot about the pivot pin 40, as clearly illustrated in FIG. 1, causing the front of the body assembly 12 to be moved upwardly.

When the drive motor 22 is caused to reverse the rotation of the drive gear 60 by proper manipulation of the rocker switch 20, the ring gears 70, 72 are driven to rotate in an opposite direction from that illustrated in FIGS. 5 and 6. Such opposite rotation will, in effect, cause the ring gear 70 to "free wheel" in respect of the split shaft 74; and the ring gear 72 will simultaneously cause rotation of the cam wheel 64. The rotation of the cam wheel 64 and the associated cam 64' urges the axle arm 46 to pivot about the pivot pin 52, causing the rear of the body assembly 12 to be urged upwardly.

In each instance, it will be understood that as soon as the cam members 62', 64' are driven to their respective apogees, the cam members 62', 64' commence to travel downwardly allowing the weight of the front or rear of the model car 10 to return the car to a position of rest at the ground level.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A model car assembly including:

a chassis;

a first set of ground engaging wheels;

a second set of ground engaging wheels;

a first set of axle arms having outer and inner ends, said axle arms rotatably receiving said first set of ground engaging wheels at the outer ends of said first set of axle arms;

a first pivotal mounting means intermediate the outer and inner ends of said first set of axle arms for pivotally mounting said first set of axle arms to said chassis;

a second set of axle arms having outer and inner ends, said axle arms rotatably receiving said second set of ground engaging wheels at the outer ends of said second set of axle arms;

a second pivotal mounting means intermediate the outer and inner ends of said second set of axle arms for pivotally mounting said second set of axle arms to said chassis;

a reversible drive motor;

a first cam member engaging said first set of axle arms between inner end thereof and said first pivotal mounting means;

a second cam member engaging said second set of axle arms between the inner end thereof and said second pivotal mounting means; and a gear train coupled to said drive motor to drive said first cam member when caused to operate in a first direction and to drive said second cam member when caused to operate in a direction opposite to the first direction.

2. A model car assembly including:

a chassis;

a first set of arms having outer and inner ends, said arms receiving ground engaging means at the outer ends thereof;

a first pivotal mounting intermediate the outer and inner ends of said first set of arms for pivotally mounting said first set of arms to said chassis;

a second set of arms having outer and inner ends, said arms receiving ground engaging means at the outer ends thereof;

a second pivotal mounting intermediate the outer and inner ends of said second set of arms for pivotally mounting said second set of arms to said chassis;

a reversible drive motor;

a first cam member engaging said first set of arms between inner end thereof and said first pivotal mounting;

a second cam member engaging said second set of arms between the inner end thereof and said second pivotal mounting; and a gear train coupled to said drive motor to drive said first cam member when caused to operate in a first direction and to drive said second cam member when caused to operate in a direction opposite to the first direction.

3. A model car assembly including:

a chassis having a first end and a second end;

a first arm pivotally mounted to said chassis;

a second arm pivotally mounted to said chassis;

a reversible drive motor having switch means for selectively driving said motor in a first direction or a second direction;

a first cam member coupled to said chassis and engaging said first arm;

a second cam member coupled to said chassis and engaging said second arm; and a gear train coupling said drive motor to said first cam member and said second cam member whereby energization of said motor in a first direction effectively drives said first cam member and energization of said motor in a second direction effectively drives said second cam member to selectively cause upward movement of the first end and the second end of said chassis.

* * * * *